United States Patent [19]

Ura et al.

[11] 4,313,674

[45] Feb. 2, 1982

[54] CLEANING APPARATUS FOR COPYING OR THE LIKE

[75] Inventors: Hiroaki Ura; Hiroyuki Honda, both of Hachioji, Japan

[73] Assignee: Konishiroku Photo Industry Co., Ltd., Tokyo, Japan

[21] Appl. No.: 105,909

[22] Filed: Dec. 21, 1979

[30] Foreign Application Priority Data

Dec. 27, 1978 [JP] Japan ..... 53-177291[U]

[51] Int. Cl.[3] ..... G03G 21/00

[52] U.S. Cl. ..... 355/15; 15/256.51; 118/652; 198/671; 222/413

[58] Field of Search ..... 198/494, 495, 496, 497, 198/498, 499, 670, 671, 530–532, 536; 15/1.5 R, 256.51, 256.52, 256.53; 355/15; 193/21; 222/513–514, 524, 539, 412–414, DIG. 1; 118/652; 141/353

[56] References Cited

U.S. PATENT DOCUMENTS 3,278,094 10/1966 Perry ..... 222/514 X 4,218,131 8/1980 Ito et al. ..... 355/15

FOREIGN PATENT DOCUMENTS 36175 6/1907 Fed. Rep. of Germany ..... 222/513

1939497 2/1971 Fed. Rep. of Germany ... 15/256.51

*Primary Examiner*—Robert B. Reeves

*Assistant Examiner*—Douglas D. Watts

*Attorney, Agent, or Firm*—Bierman & Bierman

[57] ABSTRACT

A cleaning apparatus for removable insertion in an electrophotographic copying machine includes an exhaust cylinder having an opening at an end portion thereof and a conveyor in the cylinder operable for carrying particulate developer through the cylinder to the opening thereof. A shutter having a second opening is movable with respect to the cylinder between a first position in which the shutter closes the cylinder opening and a second position in which the openings of the shutter and cylinder are aligned, a bias spring being effective to normally maintain the shutter in its first position. When the apparatus is inserted in a copying machine, the cylinder end portion is inserted into a hopper for receiving particulate developer, causing the shutter to move to its second position in which the openings are aligned to permit movement of developer into the hopper from the exhaust cylinder. Subsequent removal of the cleaning apparatus effects automatic closure of the cylinder opening to prevent leakage of developer therethrough.

5 Claims, 3 Drawing Figures

CLEANING APPARATUS FOR COPYING OR THE LIKE

BACKGROUND OF THE INVENTION

1. Field of the Invention

The present invention relates to a cleaning apparatus for an electrostatic recording apparatus, electrophotographic copying apparatus or the like. More particularly, the present invention concerns an improvement in a cleaning apparatus incorporating a toner discharging conveyer.

2. Description of the Prior Art

Recently, with a view to facilitating recovery of exhaust toner, attempts have been made to provide a toner discharging conveyer in a cleaning apparatus thereby to automatically discharge the collected toner outwardly from the cleaning apparatus.

In hitherto known cleaning apparatus, the discharge end of the discharging conveyer is arranged so as to be opened in a toner hopper. Consequently, when the cleaning apparatus is detached from an associated recording apparatus, toner often drops from the discharge end of the conveyer within the recording apparatus, whereby the interior of the recording apparatus is disadvantageously contaminated with the toner.

SUMMARY OF THE INVENTION

An object of the present invention is to eliminate the shortcomings of prior art cleaning apparatus and to provide an improved cleaning apparatus in which the discharge port of the conveyer is automatically opened and closed in response to attachment and detachment of the cleaning apparatus relative to a machine body of an associated recording apparatus.

In view of the above object, there is provided according to the present invention a cleaning apparatus for a copying machine or the like, comprising a discharging conveyer having an end portion which is adapted to be extractably inserted in a hopper and has a discharge port formed therein, a shutter member slidably supported on the end portion of the discharging conveyer under the biasing force of a spring so that the shutter member is moved back against the biasing force of the spring by an inner wall portion of the hopper when the discharging conveyer is inserted within the hopper at a predetermined position, and an opening formed in the shutter member at a location to coincide with the discharge port of the discharging conveyer at the predetermined position of the discharging conveyer inserted partially within the hopper.

Now, the invention will be described in detail by referring to the accompanying drawings.

DETAILED DESCRIPTION OF THE PREFERRED EMBODIMENT

Figure 1:
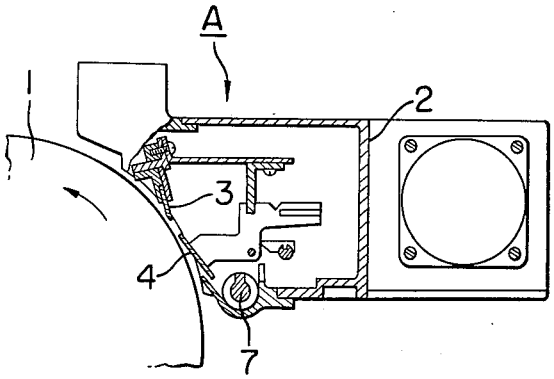
FIG. 1 is a sectional view schematically showing a general arrangement of a cleaning apparatus according to an embodiment of the present invention.

In FIG. 1, the cleaning apparatus generally denoted by a reference symbol A is disposed adjacent to a photosensitive peripheral surface of a drum 1 which is rotated in the direction indicated by an attached arrow. The cleaning apparatus comprises a toner recovering container or box 2 which is adapted to be dismounted by moving it slidably upwardly as viewed in FIG. 1 and is opened at a side located in opposition to the peripheral surface of the photosensitive drum 1. Disposed within the recovering box 2 are a cleaning blade 3 which has a pointed edge brought in contact with the peripheral surface of the photosensitive drum 1 and a guide member 4 made of a resilient material such as polyester film sheet or the like and adapted to introduce the toner scraped from the drum surface into the toner recovering box 2.

Figure 3:
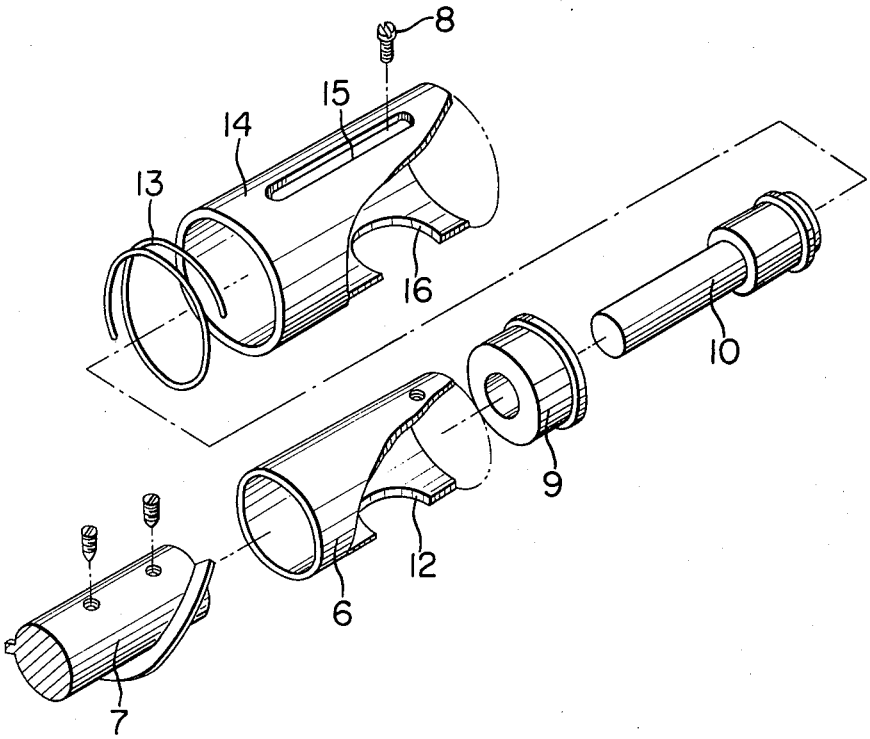
FIG. 3 is a fragmental exploded view of the same.
Figure 2:
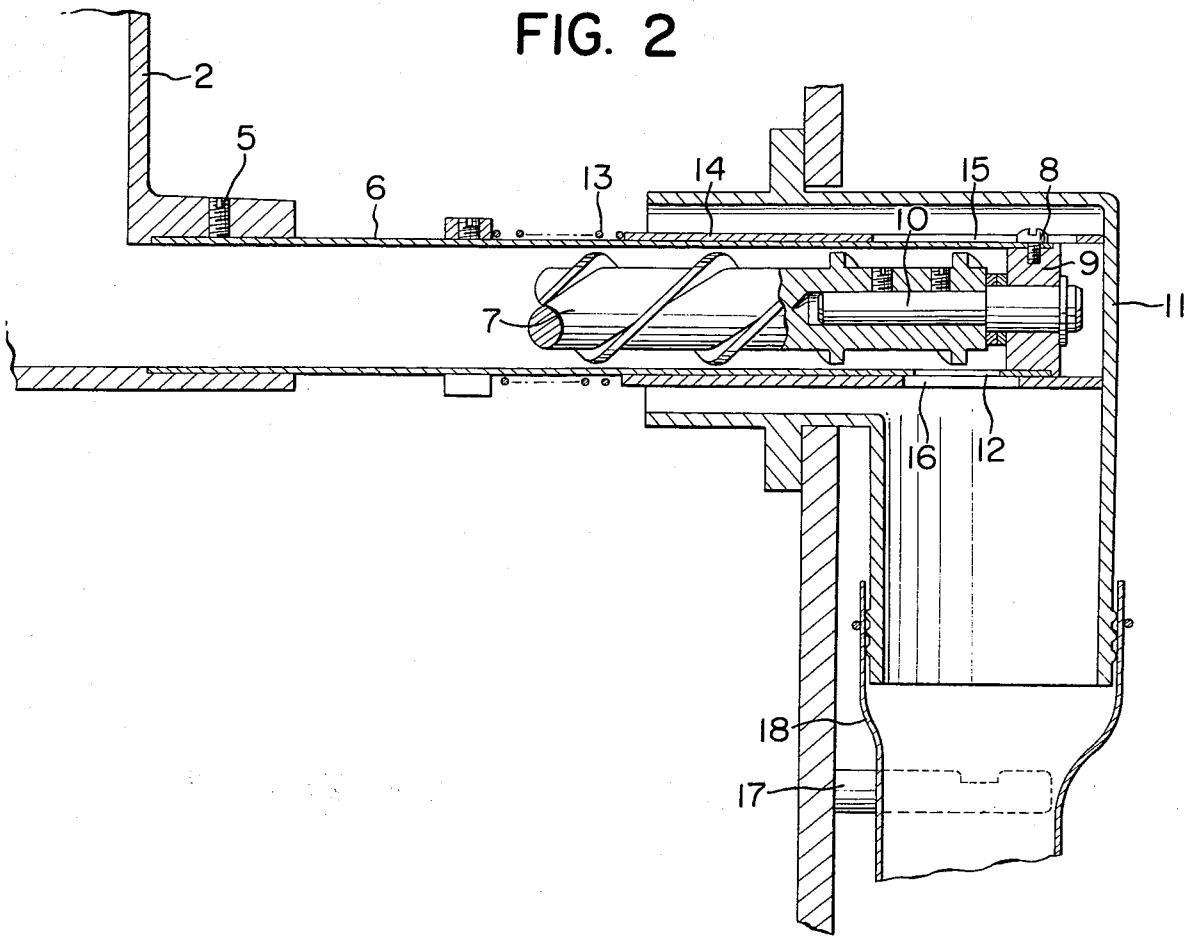
FIG. 2 is an enlarged sectional view showing a main portion of the cleaning apparatus.

A discharging conveyer is mounted in the toner recovering box or container 2 at a bottom thereof in a manner shown in FIG. 2. As will be appreciated from this description, the main construction of the cleaning apparatus according to the invention can not be shown in FIG. 1, since that portion lies concealed behind the recovering box 2. Referring to this figure together with FIG. 3, the discharging conveyer includes an exhaust cylinder 6 which is fixedly secured to the toner recovering box 2 by means of screws 5 and accommodates a screw conveyer 7 rotatably supported therein. To this end, the screw conveyer 7 is fixedly mounted on a supporting shaft 10 at an end portion remote from the toner recovering box 2. On the other hand, the supporting shaft 10 is rotatably supported in a ring 9 which is secured to the exhaust cylinder 6 at the end portion thereof by means of screws among which only one is shown at 8. Reference numeral 11 denotes a hopper in which the end portion of the screw conveyer 7 is rotatably inserted together with the exhaust cylinder 6 which is formed with an outlet opening 12 at an end portion to be located within the hopper 11 so that the toner as fed from the toner recovering box 2 through the screw 7 may fall within the hopper 11 under gravity through the outlet opening 12. Further, a cylindrical shutter member 14 is slidably mounted on the exhaust cylinder 6 at the end portion thereof to be located within the hopper 11 and is constantly urged to project outwardly from the exhaust cylinder 6 under a biasing force of spring 13. There is formed in the cylindrical shutter member 14 an elongated slot 15 in the longitudinal direction of the member 14, which slot receives therein a head portion of the screw 8 so that the cylindrical shutter member 14 is inhibited from rotation around the exhaust cylinder 6 while being permitted to move slidably in the longitudinal direction of the cylinder 6 in a range defined by the length of the elongated slot 15. Additionally, an opening 16 is formed in the cylindrical shutter member 14 at a position aligned with the outlet opening 12 formed in the exhaust cylinder 6 when the screw conveyer system is positioned within the hopper 11 to discharge the toner therein. More particularly, when the discharge conveyer system is inserted within the hopper 11 to its full depth, the cylindrical shutter member 14 will bear against the inner wall of the hopper 11 and then be moved to the left as viewed in FIG. 2 against the biasing force of the spring 13; whereby the opening 16 formed in the cylindrical shutter member 14 is brought to the position aligned with the outlet opening 12 formed in the exhaust cylinder 6, allowing the toner particles to fall into and within the hopper 11.

The toner discharged into hopper 11 is collected in a collector bag 18 suspended by a pin 17 at a stationary portion of the machine body and having an opening at which the collecting bag 18 is secured around a lower end portion of the hopper 11. In this embodiment, the cylinder, the screw conveyer 7 and the shutter member 14 are so arranged as to move with the recovering box of the cleaning apparatus.

When the cleaning apparatus is dismounted from the copying or like machine at the left side of FIG. 2, the clyindrical shutter member 14 is moved to the right as viewed in FIG. 2 under the influence of the spring 13 as the discharging conveyer is extracted from the hopper 11, as the result of which the opening 16 is displaced from the position aligned with the outlet opening 12 which is thus closed to prevent the toner from dropping within the interior of the copying or recording apparatus. On the other hand, when the cleaning apparatus is installed, the cylindrical shutter member 14 is moved to the left against the force exerted by the spring 13 as stopped by the inner wall of the hopper 11 whereby the shutter opening 16 is automatically set to the position to open the discharge port 12.

As will be appreciated from the foregoing description, there has been provided according to the present invention a cleaning apparatus having a toner discharge port (outlet opening) which is automatically closed when the cleaning apparatus is dismounted from an associated copying or the like recording apparatus, whereby danger of the toner particles being splattered within the interior of the recording apparatus can be positively excluded. Further, the apparatus according to the invention can be inexpensively realized in a simple structure.

What we claim is:

1. In a cleaning apparatus for removable insertion in an electrophotographic copying machine, a hopper for receiving particulate developer removed from the copying machine by the cleaning apparatus, an exhaust cylinder through which particulate developer from the copying machine is communicated to said hopper, said cylinder having an end portion for removable insertion in said hopper when the cleaning apparatus is inserted in the copying machine and an opening defined at said end portion through which particulate developer in said exhaust cylinder is directed into said hopper from the exhaust cylinder, means in said exhaust cylinder for operably conveying particulate developer through the cylinder to said end portion and said opening thereof, a shutter member relatively movable with respect to said exhaust cylinder between a first and a second position, biasing means between said shutter member and said exhaust cylinder for normally maintaining said shutter member in said first position covering said exhaust cylinder opening so as to close the same and prevent the movement of particulate developer out of the exhaust cylinder through said opening, and said exhaust cylinder having an opening so defined therein that insertion of said exhaust cylinder end portion into said hopper when the cleaning apparatus is inserted in the copying machine causes relative movement of said shutter member to said second position in which said shutter member opening is aligned with said exhaust cylinder opening to permit movement of particulate developer through said aligned openings into said hopper from the exhaust cylinder, whereby in subsequent removal of the cleaning apparatus from the copying machine said exhaust cylinder is retracted from said hopper whereby said biasing means causes return movement of the shutter member from said second to said first position to close said exhaust cylinder opening and thereby prevent leakage of particulate developer from the exhaust cylinder.

2. In a cleaning apparatus according to claim 1, said conveying means comprising an operatively rotatable screw conveyer for carrying particulate developer through the exhaust cylinder to said end portion and said opening thereof.

3. In an electrophotographic copying machine having a detachable cleaning apparatus for removing and recovering toner, the improvement comprising: a toner recovery box having a discharge opening, an exhaust pipe having an open entrance end connected to said discharge opening and an exit opening proximate its other end, means closing the said other end of said pipe, toner conveyor means supported within said pipe by said closing means for moving toner from the open entrance end to said exit opening, a shutter slidably mounted relative to said pipe and having an opening therethrough corresponding to the exit opening in said pipe, a hopper positioned to receive toner from the exit opening of said pipe and having an end wall adapted to be positioned adjacent the closed end of the pipe when the cleaning apparatus is connected to the copying machine, and spring means normally urging said shutter outwardly from the closed end of said pipe so that the exit opening of the pipe is normally out of alignment with the opening in said shutter and said exit opening is thereby closed, whereby when said cleaning apparatus is attached to the copying machine, said shutter is pressed against the end wall of said hopper to move the shutter relative to said pipe and against the action of said spring so that the openings in said pipe and said shutter coincide to permit toner moving through said pipe to be discharged.

4. In an electrophotographic copying machine having a detachable cleaning apparatus for removing and recovering toner according to claim 3, a collection bag detachably connected to said hopper for receiving toner discharged from said exhaust pipe.

5. In an electrophotographic copying machine having a detachable cleaning apparatus for removing and recovering toner according to claim 3, said toner conveyor means comprising an operatively rotatable screw conveyor.

* * * * *